US007415915B2

(12) United States Patent
Parrish et al.

(10) Patent No.: US 7,415,915 B2
(45) Date of Patent: Aug. 26, 2008

(54) CUTTING SYSTEM HAVING AN INTERCHANGEABLE ROTARY BLADE CARTRIDGE

(75) Inventors: Michael Parrish, Westerville, OH (US); Michael J. Schumacher, Hilliard, OH (US); Mark W. Anders, Cha Kwo Ling (HK); Kevin O'Doherty, Tseung Kwan O (HK)

(73) Assignee: Elmer's Products, Inc., Columbus, OH (US)

( * ) Notice: Subject to any disclaimer, the term of this patent is extended or adjusted under 35 U.S.C. 154(b) by 210 days.

(21) Appl. No.: 11/278,560

(22) Filed: Apr. 4, 2006

(65) Prior Publication Data

US 2006/0219078 A1 Oct. 5, 2006

Related U.S. Application Data

(60) Provisional application No. 60/668,546, filed on Apr. 5, 2005.

(51) Int. Cl.
*B26D 5/08* (2006.01)

(52) U.S. Cl. ..... 83/617; 83/481; 83/613; 30/158; 30/162

(58) Field of Classification Search ..... 83/617, 83/471, 471.2, 472, 478, 481, 613; 30/160, 30/158, 159, 161, 390
See application file for complete search history.

(56) References Cited

U.S. PATENT DOCUMENTS

| | | | | | |
|---|---|---|---|---|---|
| 821,681 | A | * | 5/1906 | Vandermark | 30/292 |
| 3,850,062 | A | * | 11/1974 | Insolio | 83/886 |
| 4,041,823 | A | * | 8/1977 | Ashbrook | 83/478 |
| 4,062,116 | A | | 12/1977 | Arnott | |
| 4,516,452 | A | | 5/1985 | Dahle | |
| 4,827,641 | A | | 5/1989 | Mori | |
| 5,069,097 | A | | 12/1991 | Mori | |
| 5,101,564 | A | | 4/1992 | Melter | |
| D341,764 | S | | 11/1993 | Birkholz | |
| D342,883 | S | | 1/1994 | Brandenburg, Jr. et al. | |
| 5,287,783 | A | | 2/1994 | Mori | |
| 5,299,355 | A | | 4/1994 | Boda et al. | |
| D346,542 | S | | 5/1994 | Birkholz | |
| D348,273 | S | | 6/1994 | Brandenburg, Jr. et al. | |
| 5,322,001 | A | * | 6/1994 | Boda | 83/485 |
| 5,355,588 | A | | 10/1994 | Brandenburg, Jr. et al. | |
| 5,365,820 | A | | 11/1994 | Mori | |
| D360,891 | S | | 8/1995 | Birkholz et al. | |
| D360,892 | S | | 8/1995 | Birkholz et al. | |

(Continued)

*Primary Examiner*—Boyer D. Ashley
*Assistant Examiner*—Sean Michalski
(74) *Attorney, Agent, or Firm*—McNees Wallace & Nurick LLC

(57) ABSTRACT

A cutting system that includes a rotary blade cartridge that can be interchangeably used with a variety of cutting tools is disclosed. The cartridge houses a rotary blade assembly that is maintained in a secure and safe retracted state and that can be activated when the cartridge is inserted into a cutting tool. Activating a plunger of any of the cutting tools causes a piston of the rotary blade assembly to move the blade to an operative cutting position protruding from an aperture provided in the cartridge housing. Deactivating the plunger causes the blade to be return to its retracted and inoperative position within the housing. Cutting tools of the invention include rail cutters such as a primary workstation and a compact workstation, circle cutters, elliptical cutters, and freeform cutters. Each cutting tool is capable of receiving a rotary blade cartridge. Cartridges are freely interchangeable between the cutting tools.

20 Claims, 15 Drawing Sheets

U.S. PATENT DOCUMENTS 5,524,515 A 6/1996 Boda
5,542,185 A 8/1996 Boda
D378,267 S 3/1997 Murkowski et al.
D382,452 S 8/1997 Murkowski et al.
5,671,647 A 9/1997 Mori
D388,305 S 12/1997 Schulz et al.
D389,715 S 1/1998 Dustin et al.
5,711,077 A * 1/1998 Schulz et al. ..... 30/160
D392,537 S 3/1998 Schulz et al.
5,765,289 A 6/1998 Schulz et al.
5,802,942 A * 9/1998 Cornell et al. ..... 83/455
D409,630 S 5/1999 Cornell et al.
5,996,459 A 12/1999 Cornell et al.
6,035,755 A 3/2000 Mori
6,079,307 A 6/2000 Mori
6,088,860 A 7/2000 Poehlmann et al.
6,098,515 A * 8/2000 Daley, Jr. ..... 83/485
6,105,257 A 8/2000 Rutkowski et al.
6,158,133 A 12/2000 Carlson et al.
6,253,652 B1 * 7/2001 Dax et al. ..... 83/481
6,460,254 B1 10/2002 Mori et al.
6,460,443 B1 * 10/2002 Hsiao ..... 83/614
6,782,785 B2 8/2004 Mori et al.
7,040,208 B2 * 5/2006 Mori et al. ..... 83/563
7,290,340 B2 * 11/2007 Lin ..... 30/292
2002/0096031 A1 * 7/2002 Yang ..... 83/614
2002/0112586 A1 * 8/2002 Mori et al. ..... 83/563
2003/0140757 A1 * 7/2003 Carlson et al. ..... 83/485
2004/0149108 A1 * 8/2004 McLean et al. ..... 83/614
2004/0177738 A1 * 9/2004 Mori et al. ..... 83/563
2005/0172774 A1 * 8/2005 Tseng ..... 83/614
2005/0223863 A1 * 10/2005 Volfson et al. ..... 83/485
2005/0284278 A1 * 12/2005 Shimizu et al. ..... 83/614
2006/0117925 A9 * 6/2006 Volfson et al. ..... 83/485
2006/0219078 A1 * 10/2006 Parrish et al. ..... 83/614
2006/0266191 A1 * 11/2006 Shih ..... 83/614
2007/0125214 A1 * 6/2007 Dong et al. ..... 83/485

* cited by examiner

CUTTING SYSTEM HAVING AN INTERCHANGEABLE ROTARY BLADE CARTRIDGE

CROSS-REFERENCE TO RELATED APPLICATIONS

This application claims priority to U.S. provisional application Ser. No. 60/668,546 filed Apr. 5, 2005, the entirety of which is hereby incorporated by reference.

BACKGROUND OF THE INVENTION

Handling cutting blades presents a risk for injury. During various cutting operations, blades must customarily be changed out, either because a blade has become dull or because a different style of blade is desired to achieve a different effect. Often, cutting tools require a specific blade size and type for the specific tool, requiring a user to have a variety of extra blades and blade styles for each type of cutting tool.

What is needed is a safe and efficient way to remove, handle and transport cutting blades for a cutting tool when not in use. What is also needed is a blade that is interchangeable with a variety of types of cutting tools.

Various features and advantages of the present invention will be apparent from the following descriptions which taken in conjunction with the accompanying drawings, illustrate by way of example only, the principles of the invention.

SUMMARY OF THE INVENTION

The present invention provides a blade cartridge for interchangeable use in a variety of rotary cutting tools and the combination of the blade cartridge with those tools. The blade cartridge comprises a cartridge housing comprising a front cartridge housing portion and a rear cartridge housing portion attached to the front cartridge housing. The cartridge housing has a generally cylindrical shape defined by an arcuate sidewall, the sidewall including a plunger receiving aperture disposed for receiving a blade activation device and a blade deployment aperture sized to permit a rotary blade to protrude from the cartridge housing when the blade activation device is inserted into the plunger receiving aperture, wherein the cartridge housing further comprises means for mounting the blade cartridge into a cutting tool. The blade cartridge also comprises a rotary blade assembly contained within the cartridge housing.

The rotary blade assembly comprises a piston assembly comprising a piston and a spring. The piston has a first end aligned with the plunger receiving aperture of the cartridge housing and an opposite second end for receiving the spring, the piston further including a piston axle aperture located between the first end and the opposite second end. The spring is mounted adjacent the second end so as to bias the first end of the piston towards the plunger receiving aperture of the cartridge housing. The rotary blade assembly further comprises a rotary blade having a central blade aperture therein for rotatable mounting onto the piston assembly and an axle inserted through the central blade aperture and the piston axle aperture to rotatably couple the blade to the piston assembly.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Where like parts are shown in more than one figure, like reference numbers are maintained for ease of reference.

DETAILED DESCRIPTION OF PREFERRED EMBODIMENTS

Exemplary embodiments of a cutting system having interchangeable rotary blade cartridges are disclosed. The cutting system may include a blade cartridge alone, or the blade cartridge in combination with one or more of the following cutting tools, each of which are described in more detail herein: a primary workstation, a compact workstation, a circle cutter, and a freeform cutter. Each cutting tool is capable of receiving at least one rotary blade cartridge, and the cartridge may be freely interchanged between the tools. The cartridge keeps a rotary blade housed in a retracted state, except when the cartridge is inserted into one of the tools of the cutting system, at which point the cartridge is locked into place in the cutting tool. Upon activation by a user, the tool activates the cartridge to move the blade assembly to an operative cutting position wherein the rotary blade protrudes from the housing and is exposed for cutting operations. The cartridge housing may be of any shape and size to house a retractable rotary blade assembly and permit blade protrusion upon activation, and is not limited to the cylindrical embodiment shown.

Figure 1C:
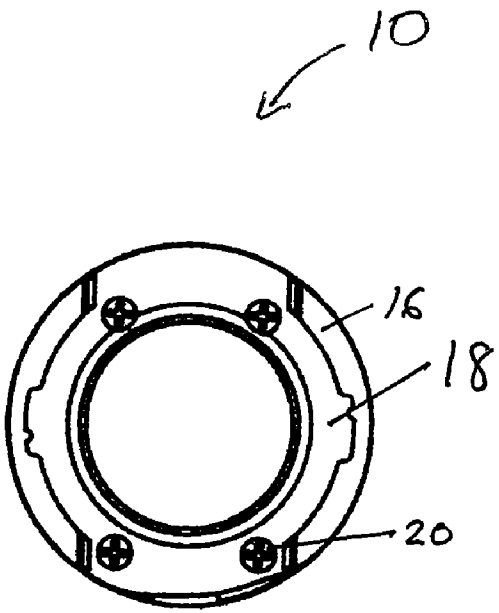
FIG. 1*c* is a rear view of a blade cartridge for use with a cutting system according to an exemplary embodiment of the invention.
Figure 1B:
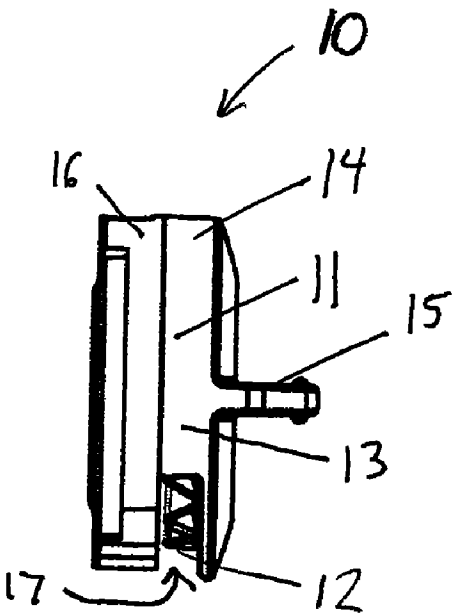
FIG. 1*b* is a side view of a blade cartridge for use with a cutting system according to an exemplary embodiment of the invention.
Figure 1A:
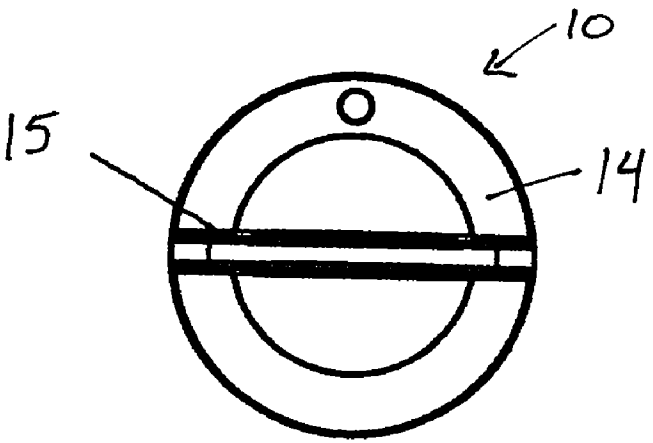
FIG. 1*a* is a front view of a blade cartridge for use with a cutting system according to an exemplary embodiment of the invention.

Referring now to FIGS. 1*a*-1*c*, a blade cartridge 10 for use in a cutting tool of a cutting system is illustrated. A rotary blade 12 is contained within a cartridge housing 11 in a retracted position. In this manner, the cartridge 10 and thus the rotary blade 12 associated with it can be interchanged between cutting tools in a safe manner without exposing a user to the peripheral cutting edge of the rotary blade. Likewise, when a user is ready to use a cutting tool, the blade cartridge 10 can be inserted into the cutting tool and the blade cartridge 10 activated to extend the blade 12 through a blade deployment aperture 17 of the cartridge housing 11, without the user needing to touch the blade 12. In this manner, the invention minimizes the risk of injury from an exposed blade during storage and transport of blade cartridges 10 and cutting tools.

Figure 2:
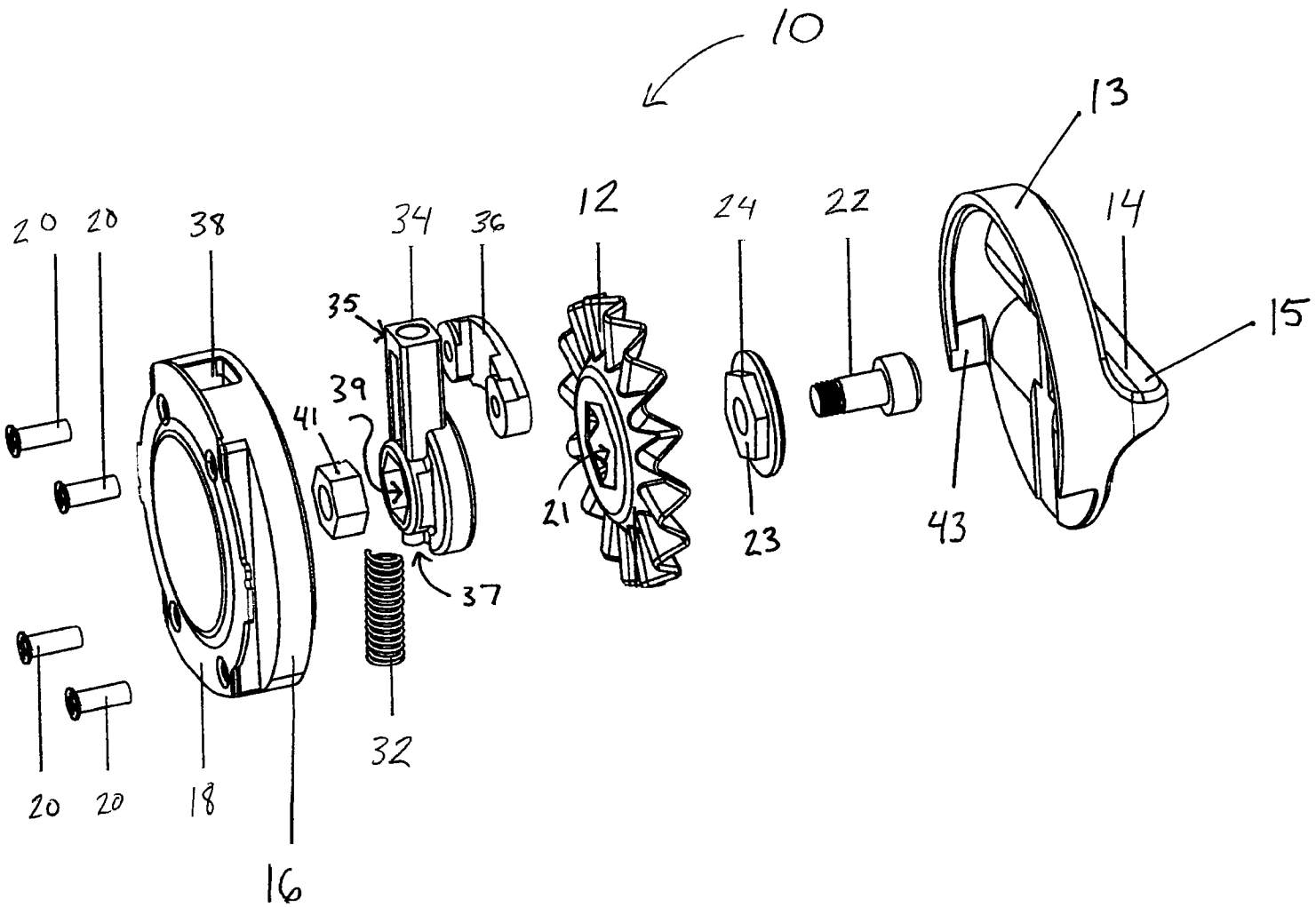
FIG. 2 is an exploded perspective view of a blade cartridge for use with a cutting system according to an exemplary embodiment of the invention.
Figure 3:
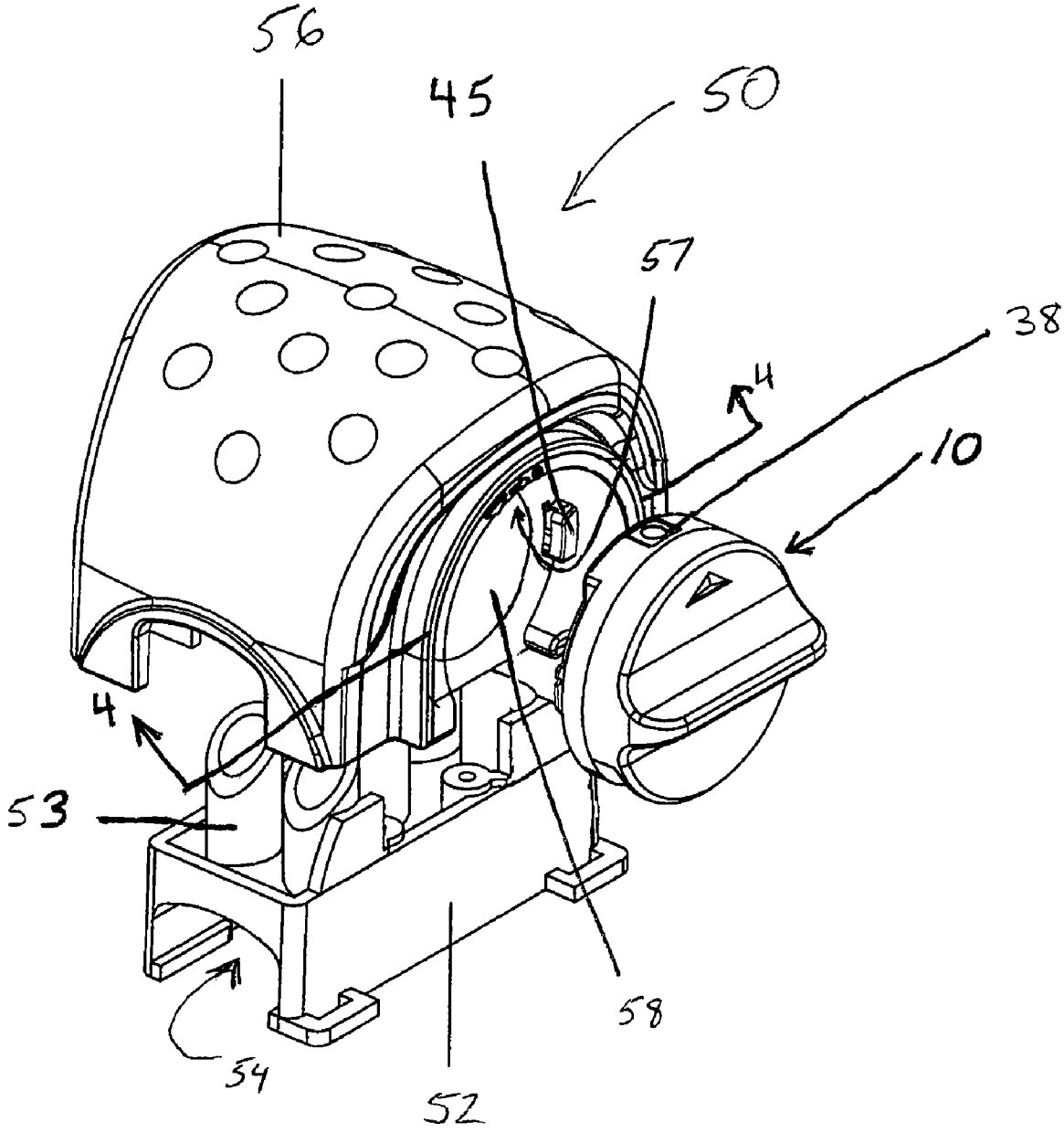
FIG. 3 illustrates a rail cutter of a cutting tool for use with a blade cartridge according to an exemplary embodiment of the invention.

FIG. 2 illustrates an exploded view of the blade cartridge 10 to better illustrate a preferred mechanism of how the rotary blade 12 is maintained in a default retracted position and how the rotary blade 12 protrudes from the cartridge 10 into an operative cutting position when installed in a cutting tool and activated by a user of the tool.

As shown in FIGS. 1-2, the cartridge housing 11 includes a front cartridge housing 14 and a rear cartridge housing 16. The front and rear cartridge housings 14, 16 may be made of metal, plastic, or any other rigid material, and can be connected by any suitable mechanism. Preferably, the housings 14, 16 preferably are connected by a weld joint using ultrasonic welding to form a uniform the assembled cartridge housing 11. The front cartridge housing 14 includes a cartridge handle 15 or other similar device by which a user may grip the cartridge 10 for insertion into a cutting tool. The rear cartridge housing 16 may further include a rear cartridge housing plate 18 attached to the rear cartridge housing 16 by one or more fasteners 20. The front and rear cartridge housings 14, 16 surround one or more rotary blades 12. For example, two blades may mounted in tandem to produce a double cutting edge that may be desirable for creating unusual cut patterns.

Figure 14:
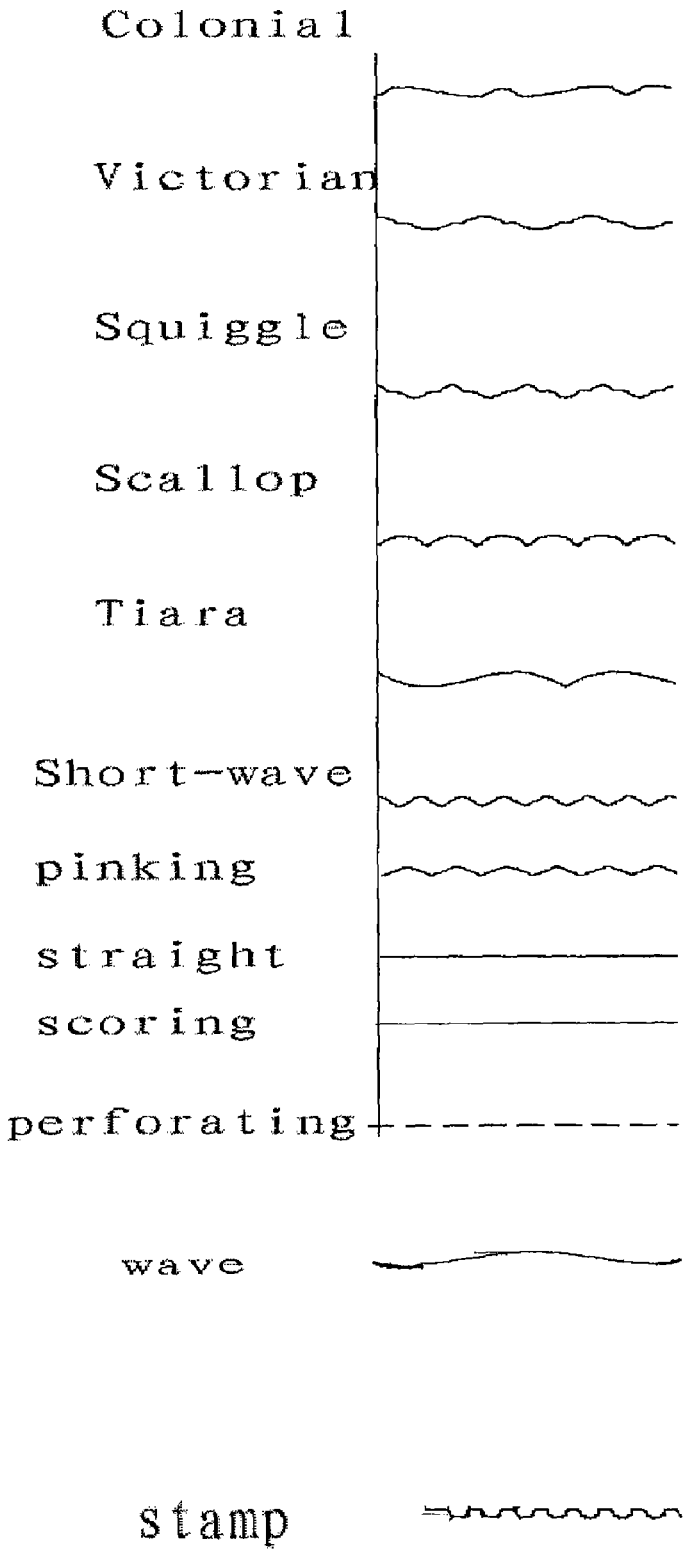
FIG. 14 illustrates various cutting patterns produced by the rotary blades of the preset invention.

The rotary blade 12 can be designed or selected to produce any desired cutting pattern. As shown in FIG. 14, the rotary blade 12 would produce a pinking cut, although any other style of cut, including, by way of example only, the patterns shown in FIG. 14, including straight, Victorian, scallop, postage stamp, squiggle, perforated, tiara, scoring, colonial, pinking, wave, short wave, and combinations thereof. The desired cut pattern may be achieved using a rotary blade 12 having an appropriately designed peripheral blade edge. Multiple cartridges 10, each having a different blade style or blade combination, can be used interchangeably with the various aforementioned cutting tools. In such an embodiment, the cartridge housing 11 may be color coded or may include other identifying characteristics to allow user to identify the blade's cutting style without activating the cartridge. For example, blade styles and combinations may be marked somewhere on the cartridge 10 itself, for example, by including a description or illustration of the cutting pattern. Additionally or alternatively, a portion of either or both of the cartridge housing 11 or blade 12 may be color coded, such as by using a distinguishing color on a portion of the front cartridge housing 14, for example.

As shown in FIGS. 1-2, the blade cartridge 10 utilizes a piston system that is part of a rotary blade assembly to enable the rotary blade 12 to extend or retract from the blade deployment aperture 17 provided in an arcuate outer sidewall 13 of the assembled housing 11. As illustrated, the blade deployment aperture 17 may be formed by a removed sidewall portion of the front cartridge housing 14. The piston assembly includes a piston 34 having a first end 35 aligned with a plunger receiving aperture 38 of the rear cartridge housing 16, a second end 37 opposite the first end 35, the second end 37 adapted to receive a piston spring 32, and a piston aperture 39 located between the first end 35 and the second end 37. The piston spring 32 is oriented so as to bias the piston 34 towards the plunger receiving aperture 38, and thereby urges the piston 34 to maintain the rotary blade 12 attached thereto in a retracted position absent a force applied to the first end 35 of the piston 34 to overcome the bias of the piston spring 32. Preferably, as shown, a piston clamp 36 is provided to maintain the piston 34 in a desired orientation and position within the cartridge housing 11. More preferably the piston clamp 36 is attached to the rear cartridge housing 16 by fasteners 20. In either embodiment, the piston clamp 36 serves to maintain alignment of the first end 35 of the piston 34 with the plunger receiving aperture 38, and to prevent the piston 34 from rotating.

An axle 22, such as a fastening pin, passes through a central blade aperture 21 of the rotary blade 12 and provides an axis about which the rotary blade 12 can rotate during cutting operations. One or more hubs 24 may be provided on the axle 22 on either side or both sides of the rotary blade 12 to maintain a desired space between the blade 12 and the cartridge housing 11 and to permit unimpeded rotation of the rotary blade 12. As illustrated in FIG. 2, the hub 24 has a non-circular protruding sidewall portion 23 that corresponds to the shape of the central blade aperture 21 and which engages the blade 12 and synchronizes the rotation of the hub 24 with the blade 12. The axle 22 is preferably threaded so that a corresponding axle nut 41 holds the piston 34, rotary blade 12, and hub 24 together in a single rotary blade assembly, thereby minimizing or eliminating lateral movement of the rotary blade along the length of the axle 22. Preferably, the piston aperture 39 is sized to receive at least a portion of the axle nut 41 to decrease the amount of space needed to retain the rotary blade assembly within the cartridge housing 11.

To extend the rotary blade 12, a force is applied to the piston 34, such as via a plunger or similar extension of a cutting tool that protrudes into the plunger receiving aperture 38, the plunger receiving aperture 38 in substantial registration with the first end 35 of the piston 34. When a sufficient force is applied to overcome the resistance of the piston spring 32, the plunger causes the piston 34 to descend, compressing the piston spring 32 against an interior sidewall of the rear cartridge housing 16. In a corresponding manner, this causes the rotary blade 12 to descend from the cartridge 10, exposing the blade 12 for use in cutting operations.

Preferably, the plunger is part of and/or actuated by a cutting tool designed to receive the cartridge 10. Thus, unless a person causes the blade 12 to descend by applying a force to the piston 34 through the plunger receiving aperture 38 other than while seated in the cutting tool, the blade 12 remains biased in a retracted position and can safely be carried, stored or handled, such as during interchange between cutting tools.

The preferred manner in which the cartridge 10 is inserted into a cutting tool and the mechanism by which the plunger causes the blade 12 to descend is illustrated with reference to FIGS. 3-5*b*, which shows a rail cutter 50. The rail cutter 50 includes a cutter body 56 and a rail guide 52 for lateral movement of the rail cutter 50 along a rail to which the rail cutter 50 may be slidably mounted, the rail passing through a channel 54 formed in the rail guide 52. The rail cutter 50 includes a cartridge reception cavity 58 to receive the blade cartridge 10.

Figure 5A:
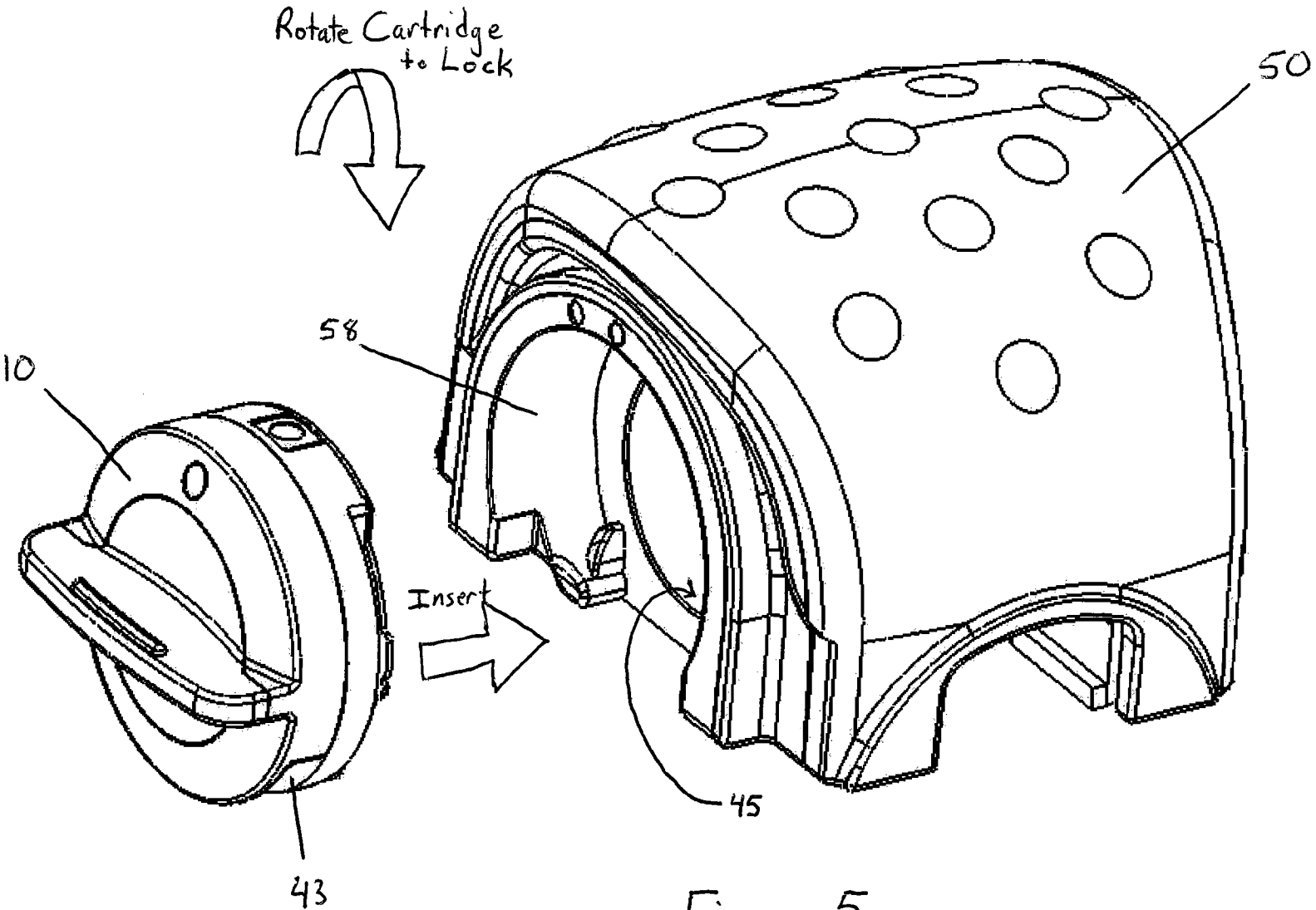
FIGS. 5*a* and 5*b* further illustrate a rail cutter and blade cartridge for insertion therein.

As shown in FIG. 5*a*, a blade cartridge 10 is inserted into the cartridge reception cavity 58 of the rail cutter 50. Preferably, the cartridge reception cavity 58 is shaped and configured to receive the cartridge 10 such that the cartridge 10 can be twisted or rotated into a locked position and so that the cartridge 10 can be rotated in an opposite direction to unlock the cartridge 10 and remove it from the rail cutter 50.

Figure 5B:
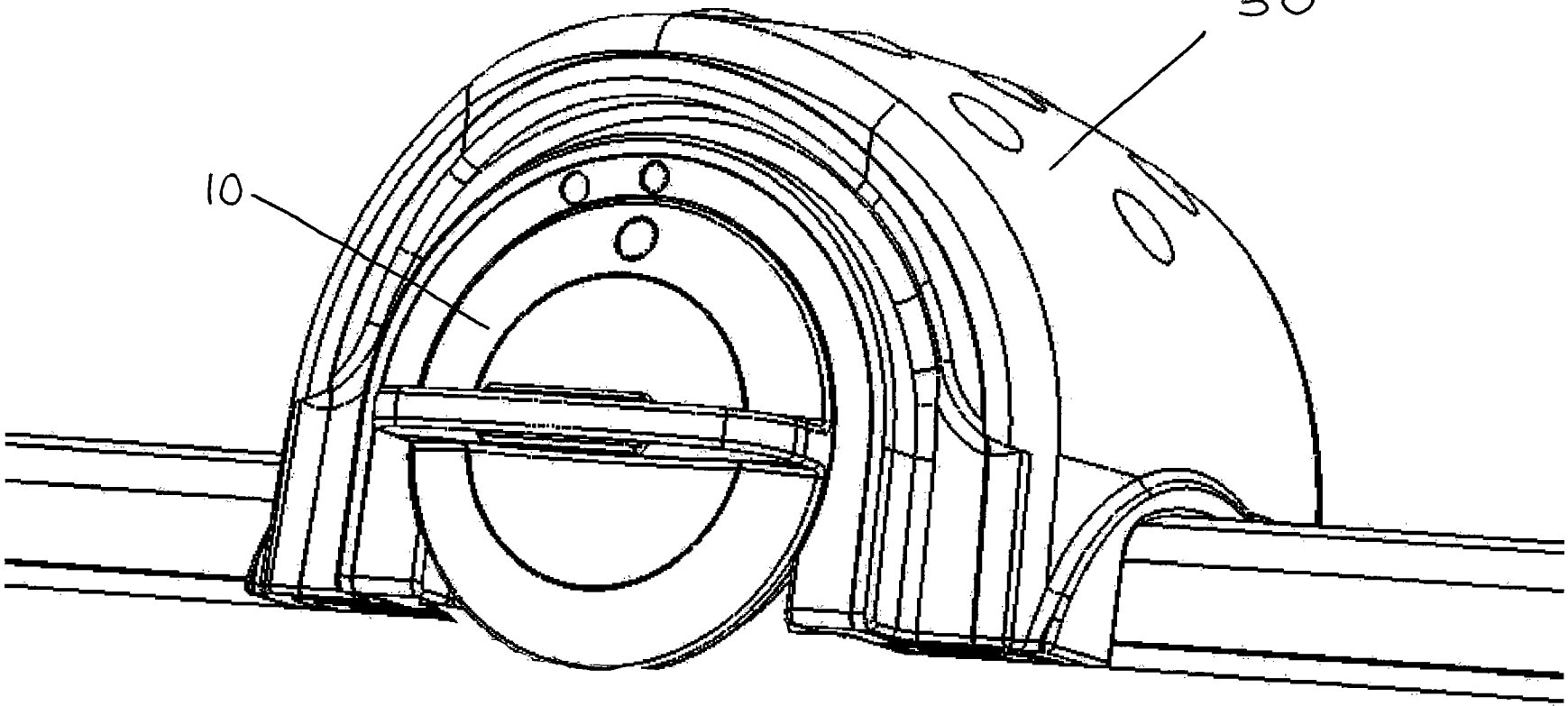

FIG. 5*b* shows a rail cutter 50 mounted on a rail for use with a cutting tool, showing the blade cartridge 10 rotated into its locked position. Preferably, the twist and lock feature is accomplished using one or more slots 43 formed in the sidewall of the front cartridge housing 14 of the blade cartridge 10, as best seen in FIG. 2, and one or more corresponding tabs 45 on the rail cutter 50, the tab(s) 45 extending into the cartridge reception cavity 58. When the blade cartridge 10 is axially rotated within the cartridge reception cavity 58, the slot 43 engages the tab 45 and retains the blade cartridge 10 in a locked position. While described with respect to a tab and slot, it should be appreciated that any structure for removably restraining the blade cartridge 10 within the cartridge reception cavity 58 could be used, such as a friction fit or opposing threads, or any combination thereof, by way of example only.

Figure 4:
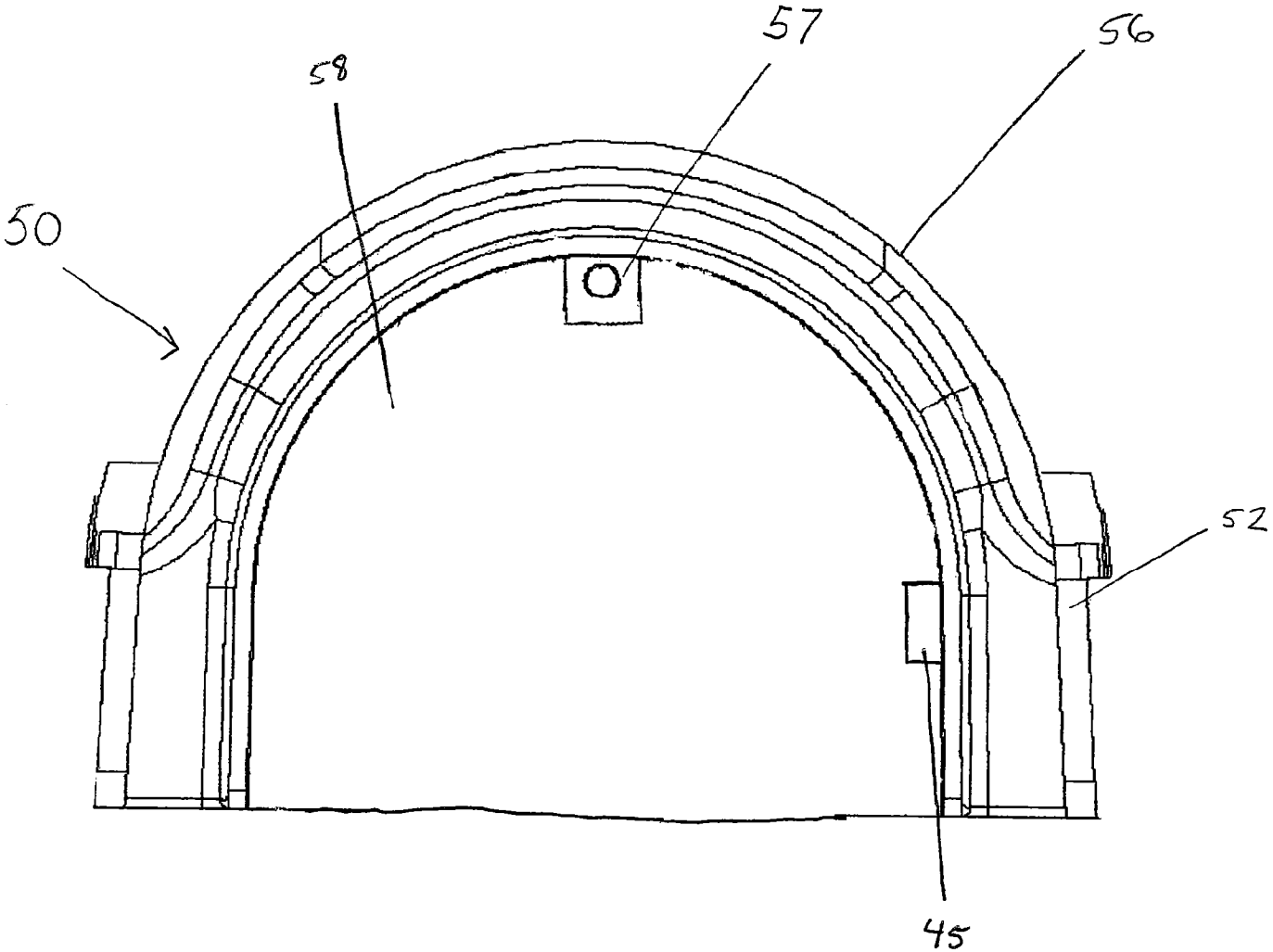
FIG. 4 illustrates a cross-sectional view of the rail cutter of FIG. 3 along line 4-4.

The cutter body 56 includes a plunger 57, which may be integral with the cutter body 56, as better seen in FIG. 4. The plunger 57 is positioned such that it is in substantial registration with the plunger receiving aperture 38 in the cartridge housing 11 when the cartridge 10 is in the locked position in the rail cutter 50. Referring again to FIG. 3, when a downward force is applied to the rail cutter 50, typically by pressing down on the cutter body 56, the plunger 57 extends in the direction of applied force, in this case downward, into the cartridge reception cavity 58. The plunger 57 thus causes the piston 34 to descend and the blade 12 attached to the piston 34 via the axle 22 and axle nut 41 also moves in the direction of applied force to protrude from the cartridge housing 11. The rotary blade 12 can still rotate freely about its axis on the axle 22.

The rail cutter 50 is preferably spring loaded, with springs (not shown) inserted into one or more spring tubes 53 formed in the rail guide 52 that bias the cutter body 56 away from the rail guide 52. When a downward force is applied to the cutter body 56, the springs are depressed and the plunger 57 descends through the plunger receiving aperture 38 to deploy the rotary blade 12 as described above. When the force is removed, the springs urge the cutter body 56 away from the rail guide 52, and the plunger 57 retreats from the plunger receiving aperture 38 of the blade cartridge 10. Thus, even when a cartridge 10 is in the rail cutter 50, the blade 12 may remain biased in the retracted position until an external force is applied.

Figure 6:
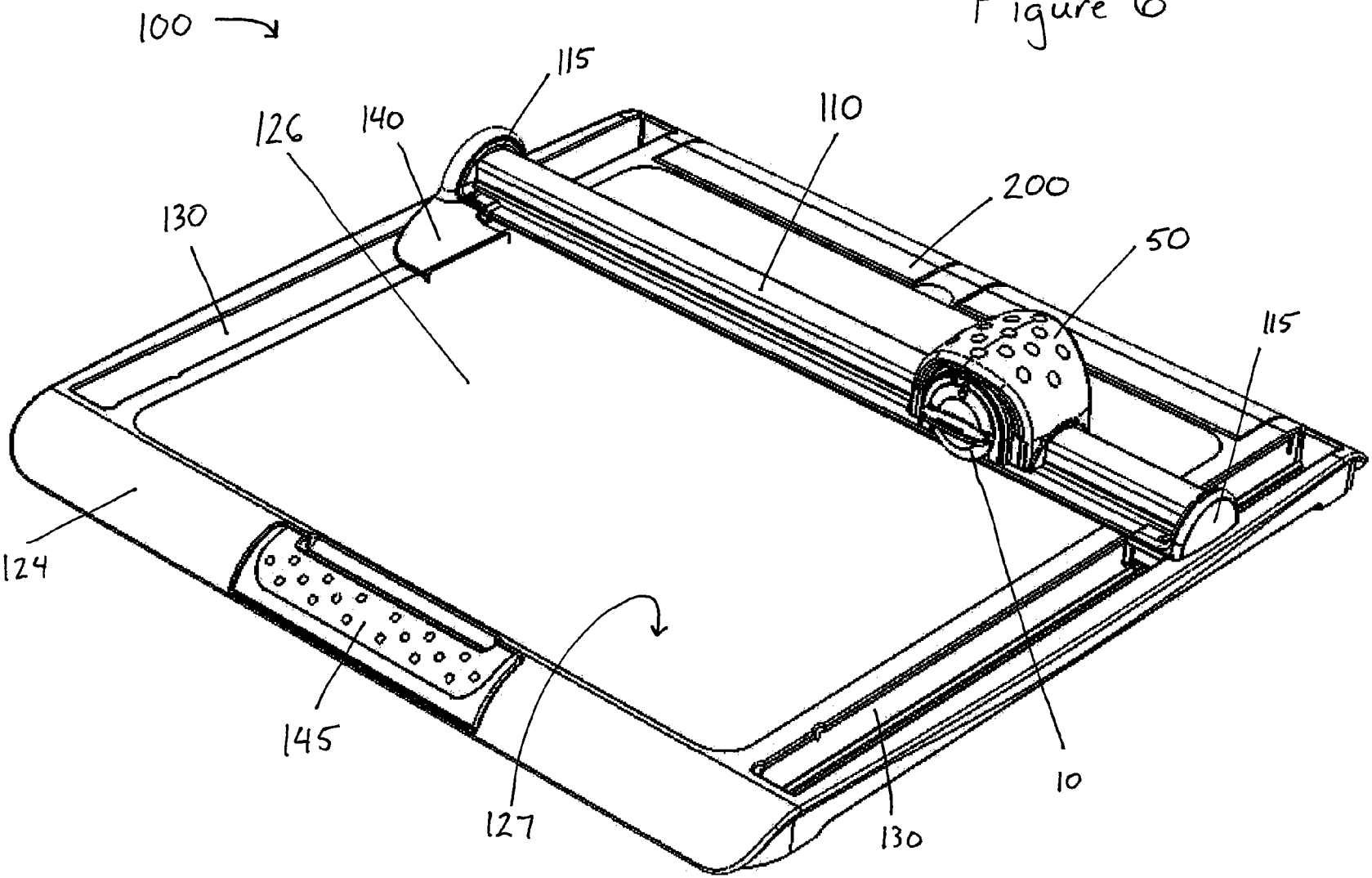
FIG. 6 illustrates a perspective view of a primary workstation for use with a blade cartridge according to an exemplary embodiment of the invention.

The rail cutter 50 can be used in combination with a primary workstation 100 as shown in FIG. 6. The rail cutter 50 is mounted on a rail 110 that extends the width of the primary workstation 100. The rail 110 is mounted over a workstation base 120 that includes a cutting region 126 and a workstation frame 124. The workstation frame 124 has an elongated workstation frame channel 130 on opposite sides of the workstation base 120. The rail 110 has a rail cap assembly 115 on each end of the rail 110, a portion of each rail cap assembly 115 fitting in the workstation frame channels 130.

Figure 8:
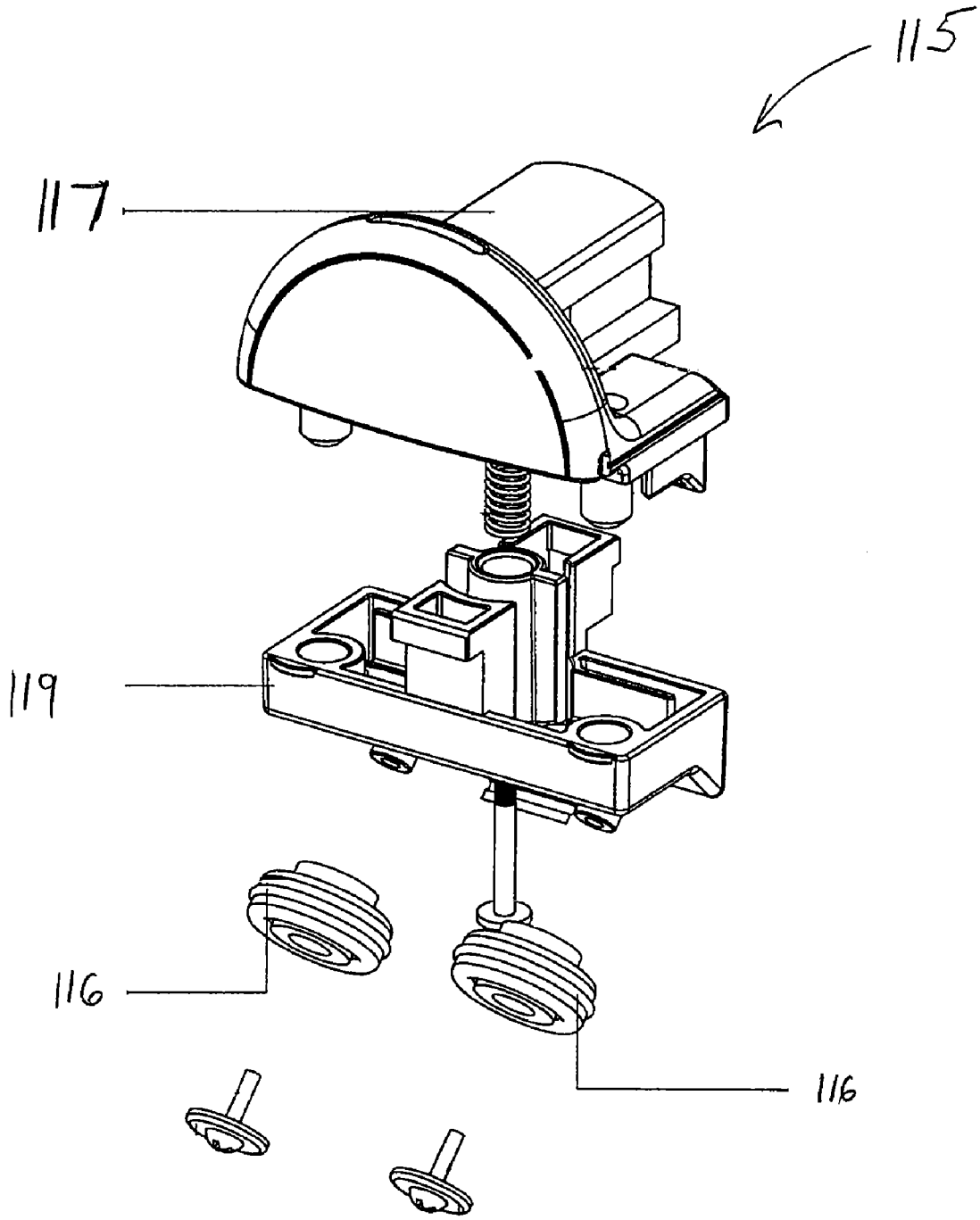
FIG. 8 illustrates an exploded view of a rail cap as found on the primary workstation according to an exemplary embodiment of the invention.

As shown in more detail in FIG. 8, the rail cap assembly 115 includes a rail cap body 117 that attaches to the rail 110 and also includes a rail cap wheel carriage 119. Wheels 116 are attached to the wheel carriage 119 to permit the rail 110 to travel more easily within the workstation frame channels 130.

Figure 13:
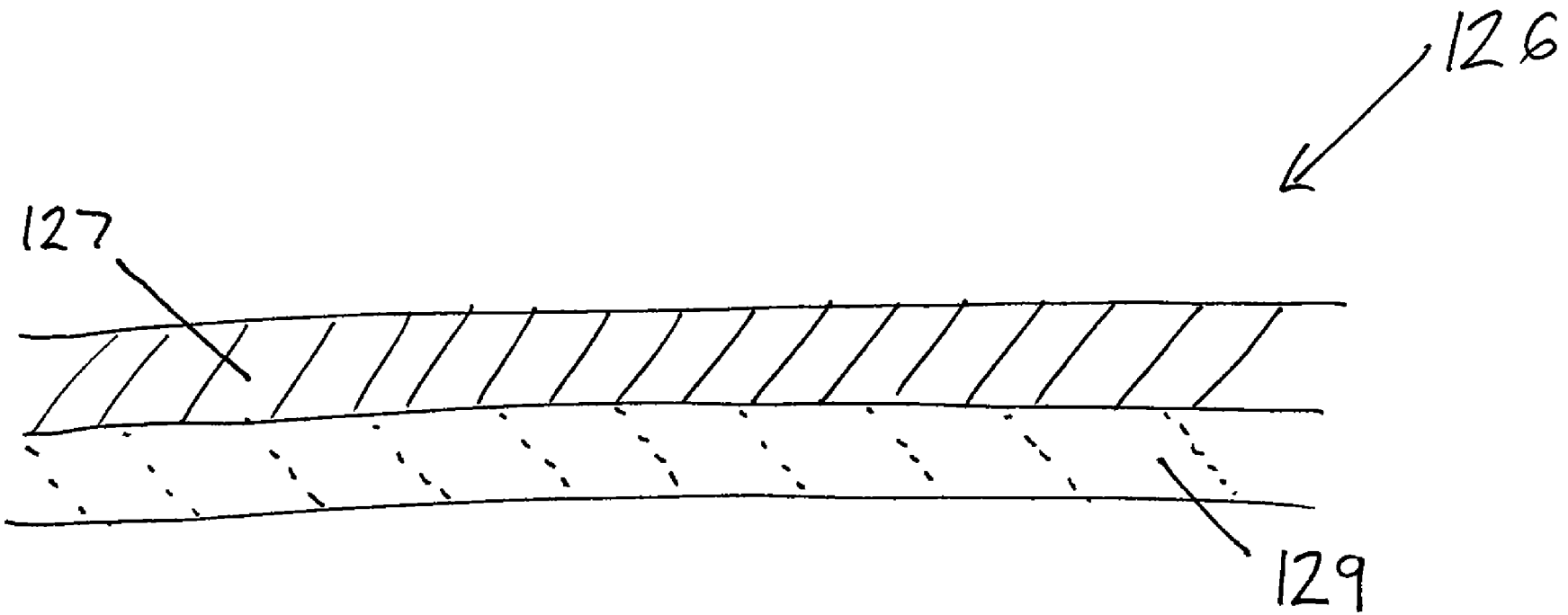
FIG. 13 is a cross-sectional view of the cutting region of the workstation illustrated in FIGS. 6 and 7.

As better seen in FIG. 13, the cutting region 126 includes a cutting surface 127 and a support 129 substantially underlying the cutting surface 127. The cutting surface 127 can be any material, but is preferably resilient to repeated cutting without dulling the blade. A typical cutting surface 127 is made from self-healing materials as are known in the art. The support 129 is a substantially flat, rigid, and preferably magnetic material. By "magnetic material" is meant both a material that is a magnet and materials that are attracted to a magnet including, for example, iron and ferrous alloys, as well as magnetic alloys. In this manner, a workpiece can be held in place on the cutting surface during cutting operations by placing one or more magnets (not shown) on the workpiece (not shown). The magnetic attraction between the support 129 and the magnets placed over the cutting surface 127 should be strong enough to prevent unwanted sliding or moving of the workpiece.

Referring again to FIG. 6, preferably the rail 110, including the rail cutter 50 slidably mounted thereon, is removable from the workstation base 120, as shown in FIG. 6, for example, by an enlarged opening at one end of each of the workstation frame channels 130. The rail cap assembly 115 may include a lock or brake to keep the rail at a desired position in the channel 130. Alternatively, or in combination, the workstation base 120 may have a home position for the rail 110 that uses a friction fit or other similar locking mechanism to retain the rail 110 at the home position.

Figure 7:
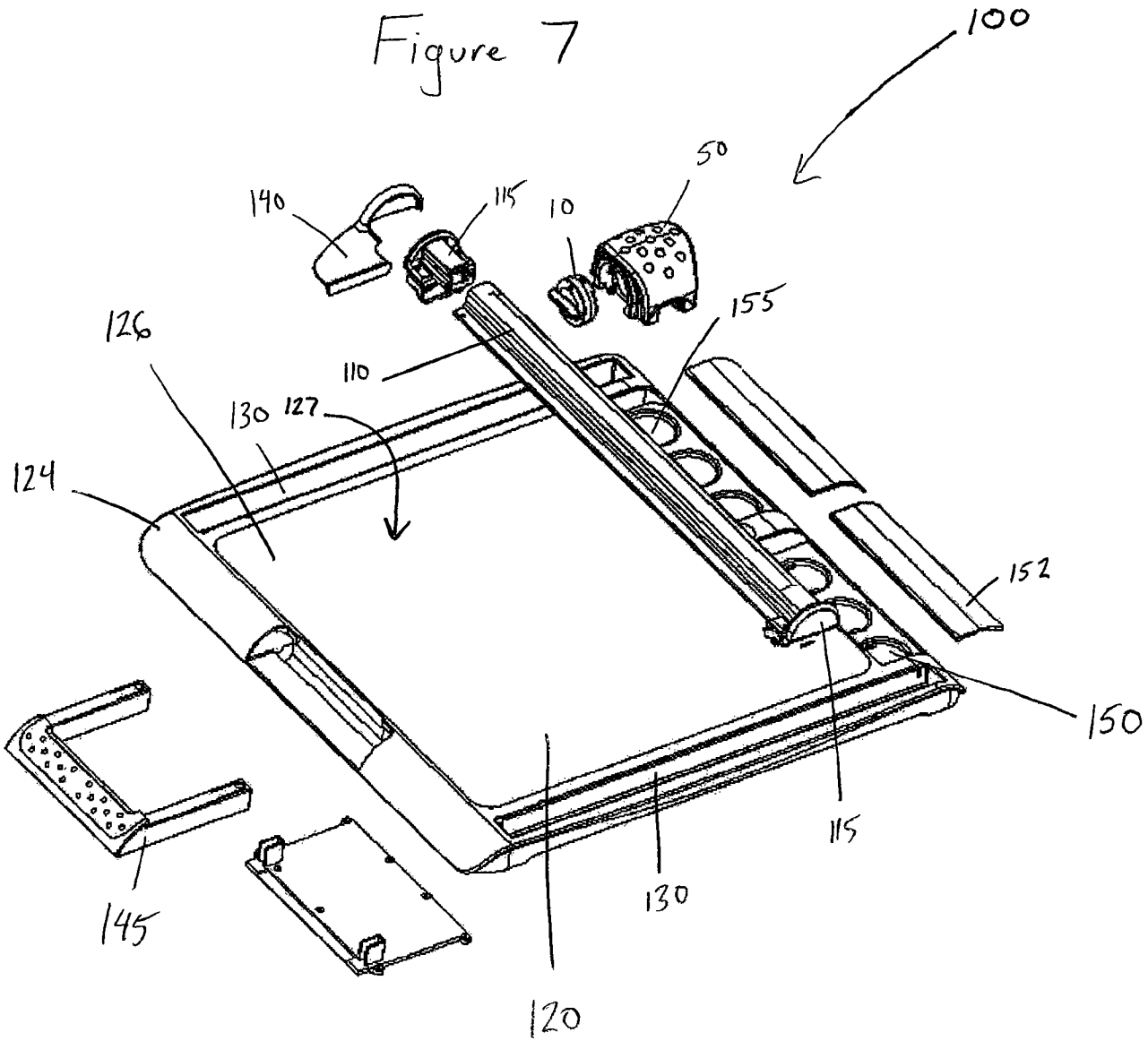
FIG. 7 illustrates an exploded perspective view of a primary workstation.

The workstation base 124 may also include a handle 145, as better seen in the exploded view of the primary workstation 100 shown in FIG. 7. The handle 145 can be extended from the workstation frame 124 in a telescoping manner for easier portability of the primary workstation 100. The workstation frame 124 is typically injection molded using a suitable polymeric material and may be constructed to include one or more depressions in the frame to create magnet receptacles 155 sized to receive magnets for use with the magnetic support 129 of the cutting region 126. Cartridge receptacles 150 may also be incorporated into the workstation frame 124. The cartridge receptacles 150 are sized to receive and hold extra blade cartridges 10, and are preferably configured so that the blade cartridges 10 can be locked by inserting and rotating them in the cartridge receptacle 150 and securely retain the cartridges 10 when not in use, in a manner similar to that described for locking the cartridge in the rail cutter 50. Magnets and blade cartridges 10 may further be retained in the workstation frame 124 by the use of one or more covers 152 placed over the receptacles 150, 155.

In some cases, it may be desirable to make square cuts to a workpiece. To assist with this aspect of cutting operations, a T-square attachment 140 may be provided that can be attached to the rail 110, preferably by placing the T-square attachment 140 over one of the rail cap assemblies 115.

Figure 9:
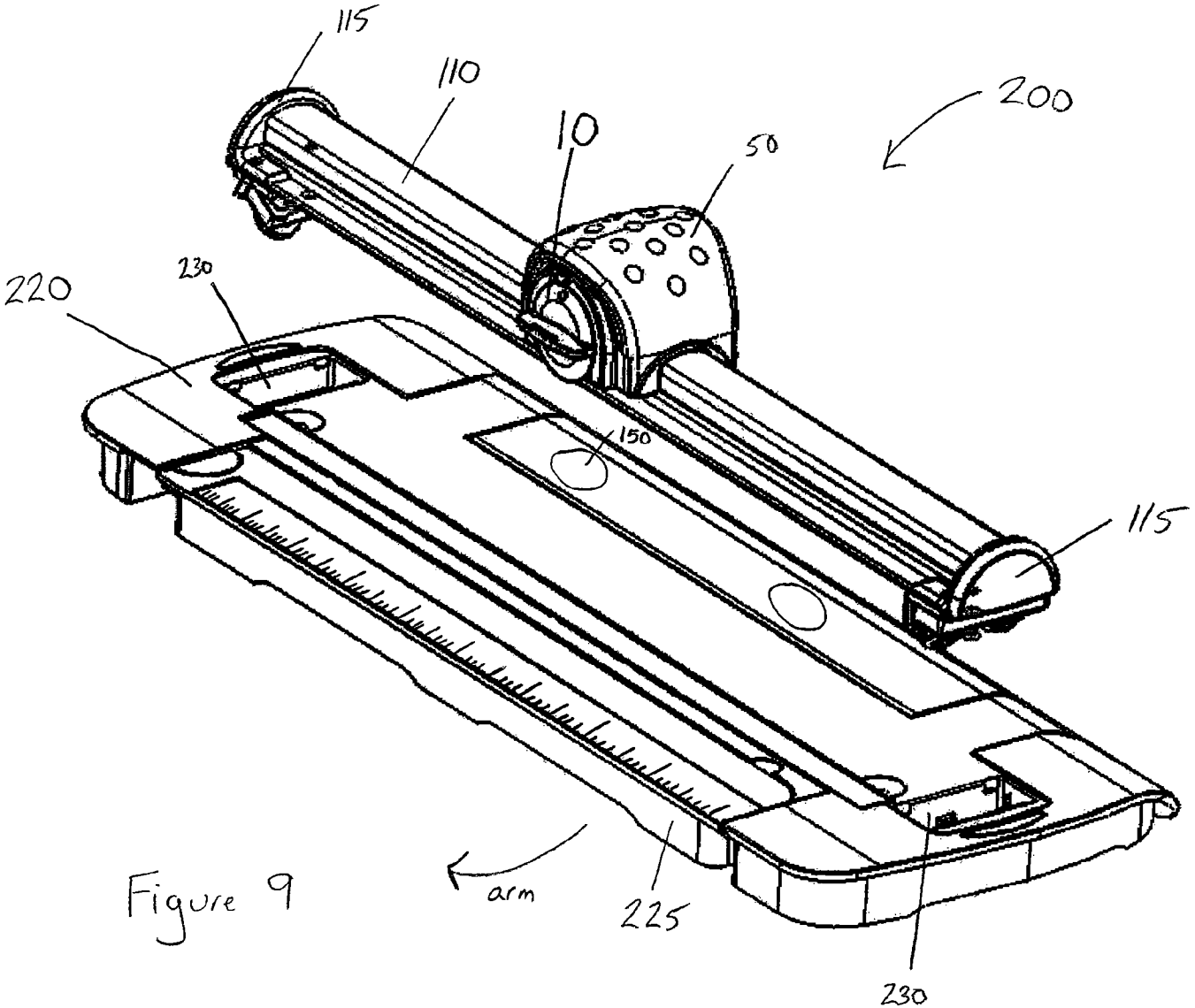
FIG. 9 illustrates a perspective view of a compact workstation for use with a blade cartridge according to another exemplary embodiment of the invention.

Another cutting tool with which the blade cartridges 10 can be used interchangeably as part of the cutting system of the present invention includes a compact workstation 200, as shown in FIG. 9. The compact workstation 200 has a compact workstation base 220 that receives a rail 110 having a rail cutter 50 slidably mounted thereon. It will be appreciated that the rail 110 for the compact workstation 200 may be interchangeable with the primary workstation 100. It will further be appreciated that even if the rail 110 is not interchangeable, the blade cartridges 10 are interchangeable. The compact workstation base 220 includes recesses 230 for receiving the rail cap assemblies 115 and which hold the rail 110 in place during cutting operations on a workpiece. Unlike the primary workstation 100, the recesses 230 of the compact workstation 200 are typically not elongated channels, and thus do not permit the rail 110 to traverse over the workpiece. The base 220 may further include one or more cartridge receptacles 150 as previously described with respect to the primary workstation 100 for storing extra blade cartridges 10 when not in installed in the rail cutter 50.

The compact workstation base 220 may also include an extendable arm 225 to provide a straight edge against which a workpiece may be abutted during cutting operations. For example, the extendable arm 225 may be fixed to the base 220 by a pin (not shown) on one end in a manner so that the arm 225 can be pivoted ninety degrees from a home position to an extended position. Advantageously, the extendable arm 225 may be ruled to provide a convenient way for a user to measure a workpiece and accomplish an accurate cut.

Figure 10B:
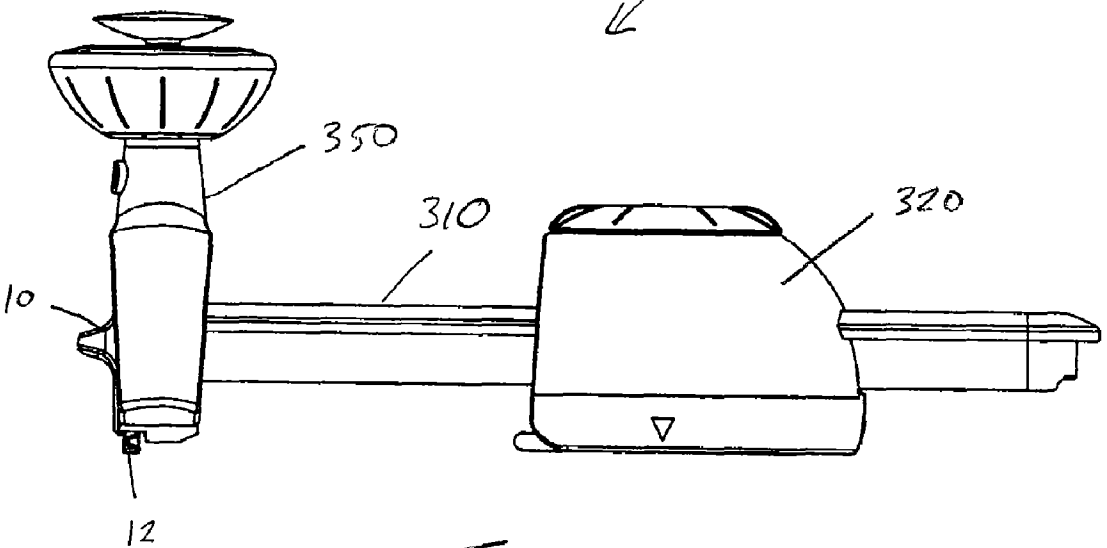
FIGS. 10*a* and 10*b* illustrate side views of a circle cutter for use with a blade cartridge according to yet another exemplary embodiment of the invention.
Figure 10A:
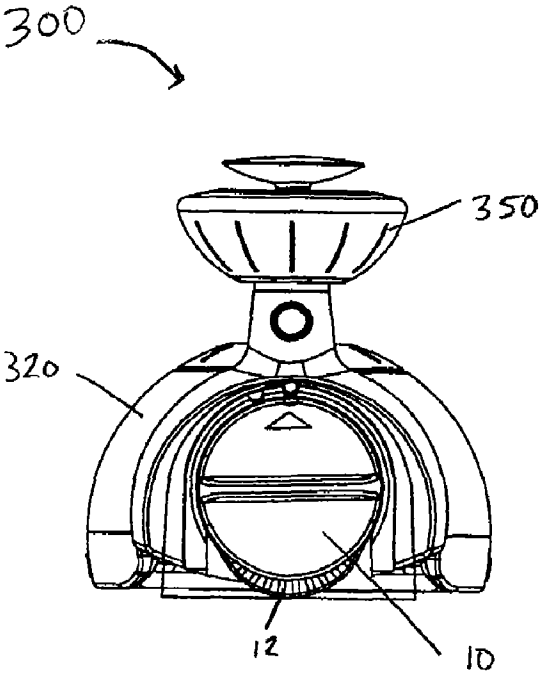

Yet another cutting tool that may be used with the blade cartridges is a circle cutter 300 as shown in FIGS. 10*a* and 10*b*. The circle cutter 300 includes a base portion 320 and a cutter portion 350 connected to the base portion 320 by a radial arm 310. The cutter portion 350 may be extended from, or retracted toward, the base portion 320 by adjusting the radial arm 310. In this manner, circles of various sizes may be cut from a workpiece when the base portion 320 is rotated about an axis.

Figure 11:
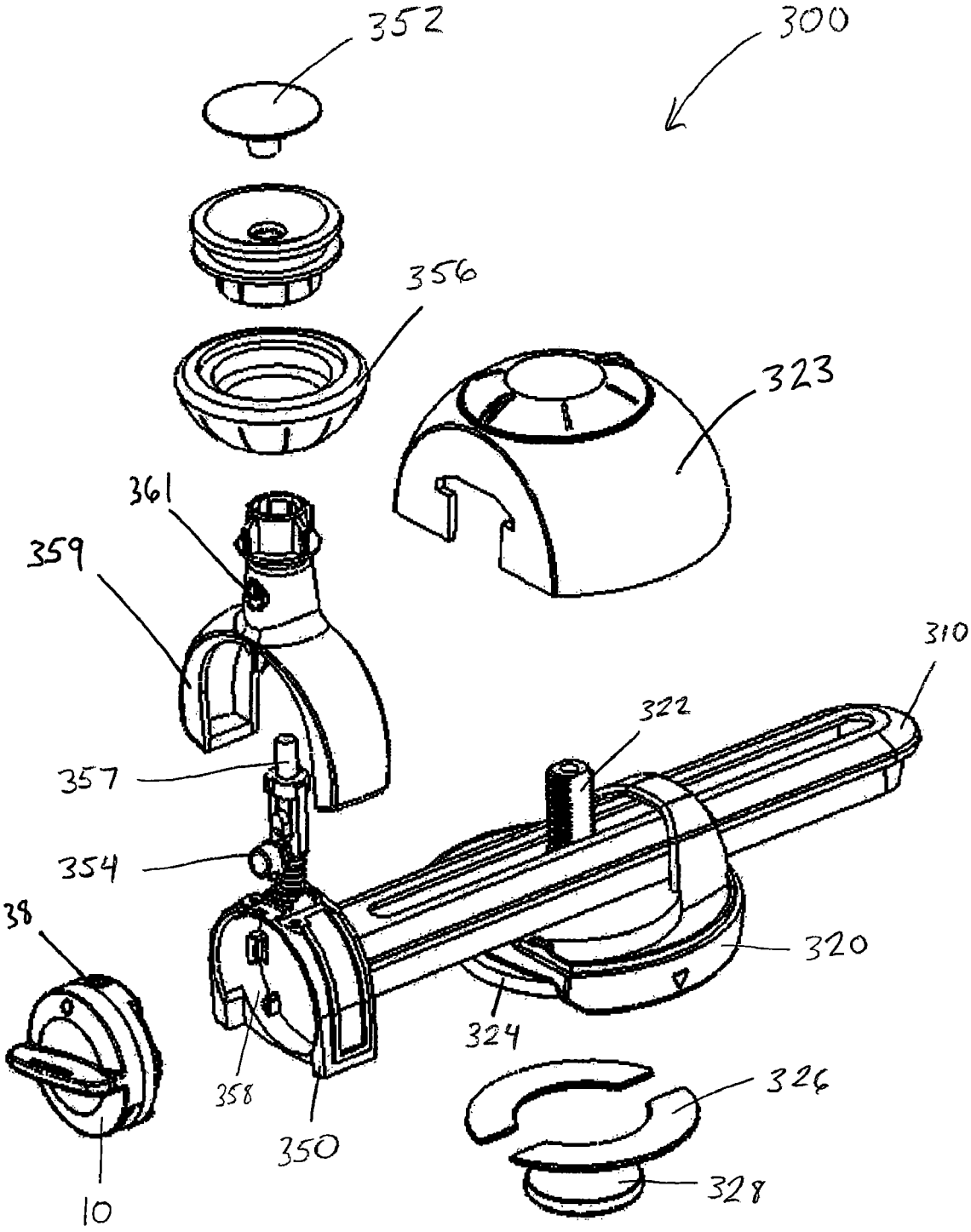
FIG. 11 illustrates an exploded perspective view of the circle cutter of FIGS. 10*a* and 10*b*.

As better seen in the exploded view shown in FIG. 11, the cutter portion 350 includes a cartridge reception cavity 358, which is sized to receive the blade cartridge 10. The blade cartridge 10 is interchangeable for use with the rail cutter 50 of the primary workstation 100 and compact workstation 200. The cutter portion 350 includes a spring-loaded plunger 357 that can be extended by depressing a top pin 352. When the plunger 357 is in the extended position, it descends through the plunger receiving aperture 38 of the blade cartridge 10, causing the blade 12 to deploy for cutting operations in a manner as previously described. As illustrated, depressing the top pin 352 also causes a cutter housing 359 intermediate the top pin 352 and the plunger 357 to move downward. The cutter housing 359 includes an aperture 361 designed to engage a release button 354 on the cutter portion 350, such that a portion of the release button 354 passes into the cutter housing aperture 361, locking the blade 12 in a deployed position. After cutting operations have been completed, the release button 354 may be depressed, causing it to withdraw from the cutter housing aperture 361, resulting in the plunger 357 retreating from the plunger receiving aperture 38 of the cartridge and consequently the rotary blade 12 retracts from its deployed position into the cartridge housing 11.

The base portion 320 of the circle cutter 300 includes a post 322 that defines an axis of rotation for the base portion 320. The base portion 320 also includes a stationary foot 324 to which the post 322 is attached, at least a portion of the post being threaded. The stationary foot 324 does not rotate, but permits the rest of the base portion 320 to rotate about its axis. The stationary foot 324 may include grips 326, such as rubber grips, tacky grips, or suction cups by way of example only, on an outer surface of the foot 324. The grips provide friction and may prevent slipping, such as when the circle cutter 300 is used on the cutting surface 127 of the primary workstation 100. The stationary foot 324 may also include a magnet 328 for attraction to the magnetic support 129 of the primary workstation's 100 cutting region 126. This also prevents slipping when the circle cutter 300 is used in conjunction with the primary workstation 100. Thus, the magnet 328 holds the circle cutter 300 firmly to the cutting surface, facilitating one handed operation of the circle cutter 300, for example, by using a knob 356 on the cutter portion 350.

The radial arm 310 can be adjusted to vary the distance between the cutter portion 350 and the base portion 320. The base portion has a threaded cap 323 that screws to the threaded post 322. Loosening the cap 323 from the post 322 allows the radial arm 310, which is preferably ruled, to be adjusted to produce the desired radius for the circle to be cut from the workpiece. When the desired position is achieved, the cap 323 is tightened on the threaded post 322 by screwing the cap 323 in the opposite direction, thereby applying pressure to the radial arm 310 to hold it in place.

Figure 12:
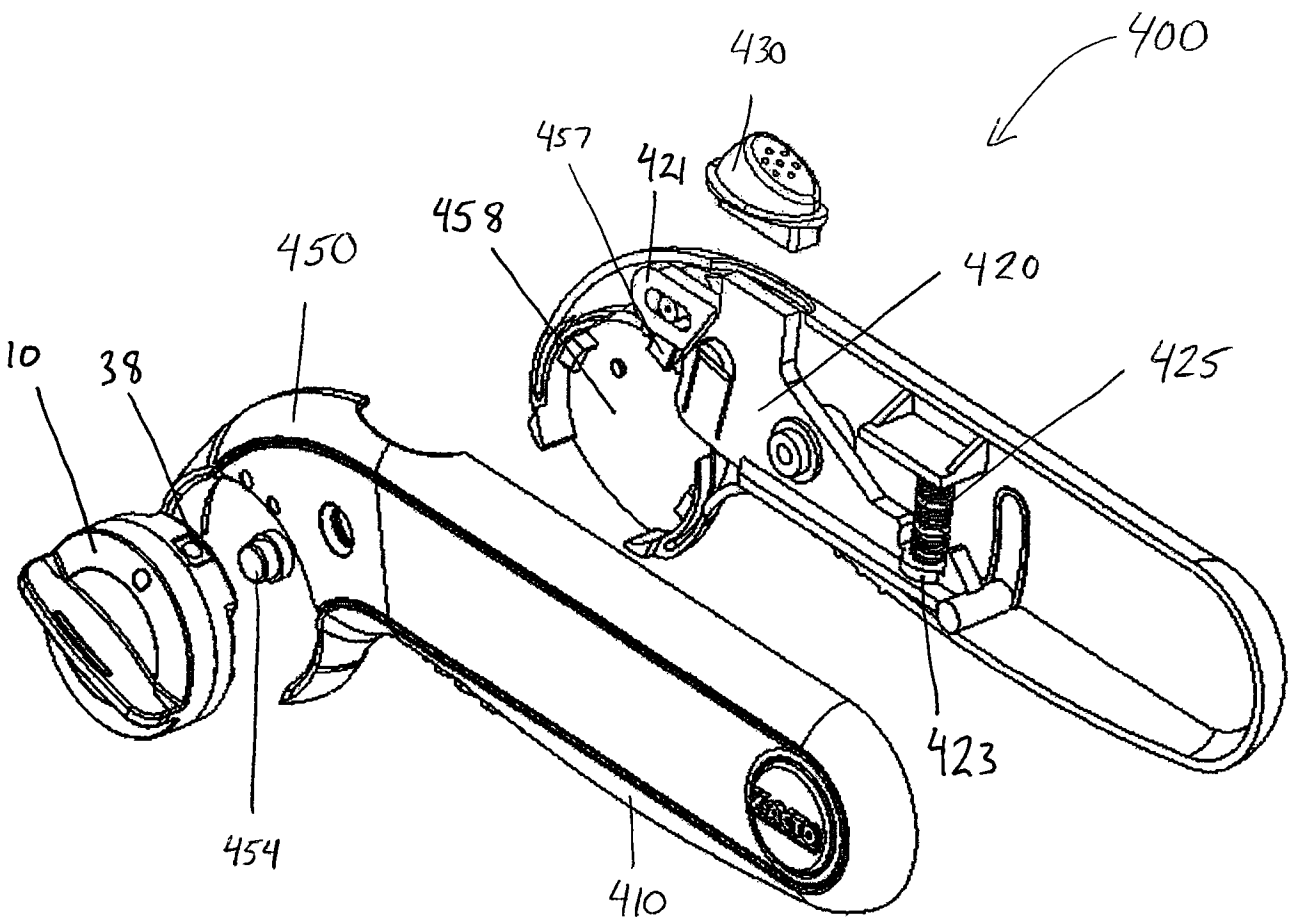
FIG. 12 illustrates a freeform cutter for use with a blade cartridge according to still another exemplary embodiment of the invention.

Still another cutting tool that can be used with the interchangeable blade cartridges 10 as part of a cutting system is a freehand or freeform cutter 400 that can be used to cut any desired shape. As shown in the exploded view of FIG. 12, the freeform cutter 400 includes a cutter portion 450, having a cartridge reception cavity 458, and a handle portion 410. A plunger 457 is actuated by a spring loaded lever 420. A thumb tab 430, when depressed, causes the plunger 457 at one end 421 of the lever 420 to descend into the plunger receiving aperture 38, while the opposite end 423 of the lever 420 compresses a lever spring 425.

Preferably, the plunger end 421 of the lever 420 locks into place as it descends to retain the rotary blade 12 in an extended position for use in cutting operations. When the user is finished using the freeform cutter 400 and wants to retract the blade 12, depressing a release button 454 releases the lever 420 from its locked position and the lever spring 425 decompresses. The lever spring 425 urges the plunger 457 upward, thus allowing the blade 12 to return its retracted position, as urged by the bias of the piston spring 32 in the blade cartridge 10.

The handle portion 410 of the freeform cutter 400 is preferably slightly curved to provide a contoured, ergonomic grip, thereby reducing stress and fatigue of the user's hand.

The figures attached hereto further illustrate various features and embodiments of cutting tools and blade cartridges that are within the scope of the present invention.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention.

We claim:

1. A blade cartridge for use in a rotary cutting tool, the blade cartridge comprising:

a cartridge housing comprising a front cartridge housing portion and a rear cartridge housing portion attached to the front cartridge housing, the cartridge housing defined by a sidewall, the sidewall including a receiving aperture disposed for receiving a blade activation device and a blade deployment aperture sized to permit a rotary blade to protrude from the cartridge housing when the blade activation device is inserted into the receiving aperture, wherein the cartridge housing further comprises means for mounting the blade cartridge into the cutting tool; and a rotary blade assembly contained within the cartridge housing, the rotary blade assembly comprising:

a piston assembly comprising a piston and a spring, the piston having a first end aligned with the receiving aperture of the cartridge housing and an opposite second end for receiving the spring, the piston further including a piston axle aperture located between the first end and the opposite second end, the spring mounted so as to bias the first end of the piston towards the receiving aperture of the cartridge housing;

a rotary blade having a central blade aperture therein for rotatable mounting onto the piston assembly; and an axle inserted through the central blade aperture and the piston axle aperture to rotatably couple the blade to the piston assembly.

2. The blade cartridge of claim 1, wherein the blade cartridge further comprises a piston clamp configured to maintain the piston in a desired orientation within the cartridge housing.

3. The blade cartridge of claim 2, wherein the piston clamp surrounds a portion of the piston between the first end and the piston axle aperture, and wherein the piston clamp is fixedly mounted to the rear cartridge housing portion.

4. The blade cartridge of claim 3, wherein the rear cartridge housing portion further includes a rear cartridge housing plate attached to the rear cartridge housing portion by a fastener, wherein the fastener engages the piston clamp.

5. The blade cartridge of claim 1, wherein the means for mounting the blade cartridge into a cutting tool comprises friction fittings, slots, tabs, threads and combinations thereof.

6. The blade cartridge of claim 5, wherein the means for mounting the cartridge into a cutting tool comprise at least one slot provided on the cartridge housing, the slot disposed so as to permit a user to engage the slot to a corresponding tab provided on a cutting tool.

7. The blade cartridge of claim 1, wherein the rotary blade includes an outer peripheral edge shaped so as to produce a predetermined cutting pattern upon rotation of the blade against a surfaced to be cut, the cutting pattern selected from the group consisting of straight, victorian, scallop, postage stamp, squiggle, perforated, tiara, scoring, colonial, pinking, wave, short wave, and combinations thereof.

8. The blade cartridge of claim 1, wherein the rotary blade assembly further comprises a hub axially mounted on the axle for maintaining a desired spacing between the blade and the cartridge housing.

9. The blade cartridge of claim 8, wherein the hub is substantially cylindrical and includes a non-circular protruding sidewall portion that mates with the central blade aperture for positively engaging the rotary blade and synchronizing the rotation of the hub with the rotary blade.

10. The blade cartridge of claim 8, wherein the axle has a threaded end, and wherein the rotary blade assembly further comprises an axle nut attached to the threaded end of the axle, wherein the rotary blade is intermediate the hub and the axle nut.

11. The blade cartridge of claim 1 assembled to the cutting tool, wherein the cutting tool further comprises:

blade activation means in substantial registration with the receiving aperture of the cartridge housing, and means for receiving the blade cartridge, wherein the means for receiving the blade cartridge corresponds to the means for mounting the blade cartridge.

12. The blade cartridge and cutting tool combination of claim 11, wherein the means for mounting the blade cartridge into the cutting tool is selected from the group consisting of friction fittings, slots, tabs, threads or combinations thereof, and wherein the means for receiving the blade cartridge correspond to the means for mounting the blade cartridge.

13. The blade cartridge and cutting tool combination of claim 11, wherein the cutting tool is selected from the group consisting of a freeform cutter, a rail cutter, and a circle cutter.

14. The blade cartridge of claim 13 assembled to the cutting tool, wherein the cutting tool is a freeform cutter tool, wherein the freeform cutter tool further comprises:

a cutter portion having cartridge receiving means including a cartridge reception cavity, a handle portion connected to the cutter portion; and blade activation means comprising a plunger connected to a plunger activating means, the plunger activating means configured to cause the plunger to protrude into the receiving aperture of the cartridge housing when the blade cartridge is positioned in the cartridge reception cavity of the freeform cutter tool.

15. The blade cartridge and freeform cutter tool of claim 14, wherein the plunger activating means comprise a spring loaded lever pivotally mounted within the handle portion of the freeform cutter tool, the lever having a plunger end located adjacent the cartridge reception cavity and a second end opposite the plunger end, the second end connected to a spring to bias the lever to an inactive position.

16. The blade cartridge of claim of 13 assembled to the cutting tool, wherein the cutting tool is a rail cutter tool, wherein the rail cutter tool further comprises:

a cutter body comprising:

cartridge receiving means including a cartridge reception cavity; and blade activation means including a plunger, wherein the plunger is in substantial registration with the receiving aperture of the cartridge housing when the blade cartridge is positioned within the cartridge reception cavity; and a rail guide, the rail guide having a channel for slidably mounting the rail guide on a rail to permit lateral movement of the rail cutter thereon.

17. The blade cartridge and rail cutter combination of claim 16, wherein the rail cutter includes one or more rail cutter springs inserted into corresponding rail cutter spring tubes on the rail guide such that the rail cutter springs bias the rail cutter body opposite the piston spring of the blade cartridge in the absence of an external force applied to the rail cutter.

18. The blade cartridge and rail cutter combination of claim 16, wherein the rail cutter is slidably mounted on a rail attached to a workstation, the workstation further comprising:

a workstation base comprising a frame portion and a cutting region, wherein the cutting region includes a cutting surface overlying a substantially rigid magnetic support, wherein the rail is movably positioned over at least a portion of the cutting region.

19. The blade cartridge of claim 13 assembled to the cutting tool, wherein the cutting tool is a circle cutter tool, wherein the circle cutter tool further comprises:

a base portion, the base portion providing an axis of rotation about which an attached cutter portion can be rotated; and a cutter portion attached to the base portion by an adjustable radial arm such that the distance of the cutter portion from the base portion may be selectively modified, the cutter portion including a cartridge reception cavity for receiving the blade cartridge.

20. The blade cartridge and circle cutter combination of claim 19, wherein the cutter portion includes a spring-loaded plunger that can be extended into the receiving aperture of the blade cartridge to activate the piston and thereby deploy the rotary blade, and wherein the base portion includes a stationary foot including means for maintaining the foot in a desired location on a cutting surface, the means selected from the group consisting of rubber grips, tacky grips, magnets, suction cups, and combinations thereof.

* * * * *